US008033726B2

(12) United States Patent
McTavish et al.

(10) Patent No.: US 8,033,726 B2
(45) Date of Patent: Oct. 11, 2011

(54) BULK BAG HANDLING ASSEMBLY

(75) Inventors: Gordon McTavish, Edmonton (CA); Gerald L. Baker, Ardrossan (CA)

(73) Assignee: LSI—Lift Systems Incorporated, Edmonton, Alberta (CA)

( * ) Notice: Subject to any disclaimer, the term of this patent is extended or adjusted under 35 U.S.C. 154(b) by 986 days.

(21) Appl. No.: 11/349,440

(22) Filed: Feb. 7, 2006

(65) Prior Publication Data

US 2006/0175218 A1 Aug. 10, 2006

(51) Int. Cl.
*B65D 33/06* (2006.01)
*B65D 30/10* (2006.01)

(52) U.S. Cl. ..... 383/16; 383/121

(58) Field of Classification Search ..... 383/7, 121, 383/121.1, 16

See application file for complete search history.

(56) References Cited

U.S. PATENT DOCUMENTS

| | | | | | |
|---|---|---|---|---|---|
| 2,159,622 | A | | 5/1939 | Sanford | |
| 2,489,054 | A | * | 11/1949 | Sprolle | 206/386 |
| 2,698,696 | A | * | 1/1955 | Strong | 206/598 |
| 2,758,776 | A | * | 8/1956 | Tevander | 206/386 |
| 2,896,798 | A | * | 7/1959 | Celley | 206/600 |
| 2,930,481 | A | * | 3/1960 | Bebie | 206/597 |
| 3,022,906 | A | * | 2/1962 | Sandusky | 414/814 |
| 3,165,078 | A | | 1/1965 | White | |
| 3,329,103 | A | | 7/1967 | Cohen | |
| 3,469,542 | A | | 9/1969 | Ahlenius | |
| 3,651,769 | A | | 3/1972 | Foley | |
| 3,659,534 | A | * | 5/1972 | Childs | 108/51.3 |
| 3,695,187 | A | | 10/1972 | Weiss | |
| 3,858,526 | A | | 1/1975 | Lombard et al. | |
| 3,878,796 | A | | 4/1975 | Morrison | |
| 3,880,092 | A | | 4/1975 | Seeber et al. | |
| 3,880,286 | A | | 4/1975 | Wegener | |
| 3,942,654 | A | | 3/1976 | Warrick | |
| 4,029,023 | A | | 6/1977 | Rosewicz et al. | |
| 4,319,529 | A | | 3/1982 | Beal | |
| 4,445,614 | A | * | 5/1984 | Mitsumori et al. | 206/599 |
| D277,042 | S | | 1/1985 | Carter et al. | |
| 4,509,433 | A | * | 4/1985 | Farr | 108/52.1 |
| 4,830,191 | A | | 5/1989 | Dijksman | |
| 5,044,502 | A | | 9/1991 | Hale | |
| 5,067,418 | A | * | 11/1991 | Carter | 108/56.3 |

(Continued)

FOREIGN PATENT DOCUMENTS

| | | |
|---|---|---|
| CA | 2205840 | 11/1995 |

(Continued)

OTHER PUBLICATIONS

Europal, 'Four-way Pallets', available at http://www.europal.net/pallets/type/quatre_entrees.htm, available as early as Apr. 29, 2002.

*Primary Examiner* — Jes F Pascua
(74) *Attorney, Agent, or Firm* — Davis & Bujold P.L.L.C.

(57) ABSTRACT

A bulk bag handling assembly, includes a bulk bag having a bottom and opposed pairs of peripheral side walls. A pair of outer lifting tine receiving channels are provided along the bottom in parallel spaced relation to one of the opposed pairs of peripheral side walls. A pair of inner lifting tine receiving channels positioned between the outer lifting tine receiving channels. The bulk bag handling assembly described can be used with a wide variety of lifting equipment.

2 Claims, 7 Drawing Sheets

U.S. PATENT DOCUMENTS

| | | | | |
|---|---|---|---|---|
| 5,170,722 | A | 12/1992 | Friesner et al. | |
| D345,847 | S | 4/1994 | Schuchard | |
| 5,367,960 | A | 11/1994 | Schleicher | |
| 5,440,998 | A | 8/1995 | Morgan, IV et al. | |
| 5,456,189 | A | 10/1995 | Belle Isle | |
| 5,461,988 | A | 10/1995 | Cummings et al. | |
| 5,507,237 | A | 4/1996 | Barrow et al. | |
| 5,537,937 | A | 7/1996 | Juvik-Woods | |
| 5,662,048 | A | 9/1997 | Kralj | |
| 5,676,063 | A | 10/1997 | Wallace | |
| D387,557 | S | 12/1997 | Provot | |
| 5,785,175 | A | 7/1998 | Cholsaipant | |
| 5,794,543 | A | 8/1998 | John et al. | |
| 5,809,905 | A | 9/1998 | John et al. | |
| 5,836,254 | A | 11/1998 | Johansson | |
| 6,041,719 | A | 3/2000 | Vidal et al. | |
| 6,213,305 | B1 | 4/2001 | Baker et al. | |
| 6,263,807 | B1 | 7/2001 | Fox et al. | |
| 6,299,011 | B1 | 10/2001 | Rosenfeldt | |
| D453,603 | S | 2/2002 | Bray et al. | |
| 6,467,625 | B2 | 10/2002 | Baker et al. | |
| D466,690 | S | 12/2002 | Walsh | |
| 6,533,121 | B1 | 3/2003 | Ross | |
| D473,052 | S | 4/2003 | Dehenau | |
| D478,421 | S | 8/2003 | Overholt et al. | |
| D492,835 | S | 7/2004 | Michaels et al. | |
| 6,935,500 | B1 | 8/2005 | Schnaars | |
| 6,938,558 | B1 | 9/2005 | Peres | |
| 7,025,208 | B2 * | 4/2006 | Baker et al. | 206/599 |
| 7,516,706 | B2 * | 4/2009 | Creighton et al. | 108/56.3 |
| 2001/0027826 | A1 * | 10/2001 | Carpenter | 141/313 |
| 2002/0011194 | A1 | 1/2002 | Lacabanne | |
| 2003/0005862 | A1 | 1/2003 | Halavais | |
| 2003/0235349 | A1 | 12/2003 | Ricahrdson, Jr. et al. | |
| 2004/0025756 | A1 | 2/2004 | Baker et al. | |
| 2004/0159565 | A1 | 8/2004 | Von Merveldt | |
| 2004/0264814 | A1 | 12/2004 | Eisenbarth et al. | |

FOREIGN PATENT DOCUMENTS

| | | |
|---|---|---|
| CA | 2310556 | 10/2001 |
| DE | 94 16 379 | 1/1995 |
| EP | 0 080 126 A1 | 6/1983 |
| EP | 0 115 551 A1 | 8/1984 |
| GB | 2 161 452 A | 1/1986 |

* cited by examiner

BULK BAG HANDLING ASSEMBLY

This application claims priority from Canadian Application Serial No. 2,496,254 filed Feb. 7, 2005.

FIELD OF THE INVENTION

The present invention relates to an assembly, which has been developed to facilitate handling of bulk bags by lifting equipment.

BACKGROUND OF THE INVENTION

Bulk bags are used to transport a wide variety of products. In order to facilitate movement of the bulk bags using lifting equipment, bulk bag handling assemblies are used which include tubular lift tine receiving members are secured to a bottom of the bulk bag. U.S. Pat. Nos. 6,213,305 and 6,467,625 are examples of such bulk bag handling assemblies.

SUMMARY OF THE INVENTION

According to the present invention there is provided a bulk bag handling assembly, which includes a bulk bag having a bottom and opposed pairs of peripheral side walls. A pair of outer lifting tine receiving channels are provided along the bottom in parallel spaced relation to one of the opposed pairs of peripheral side walls. A pair of inner lifting tine receiving channels positioned between the outer lifting tine receiving channels.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
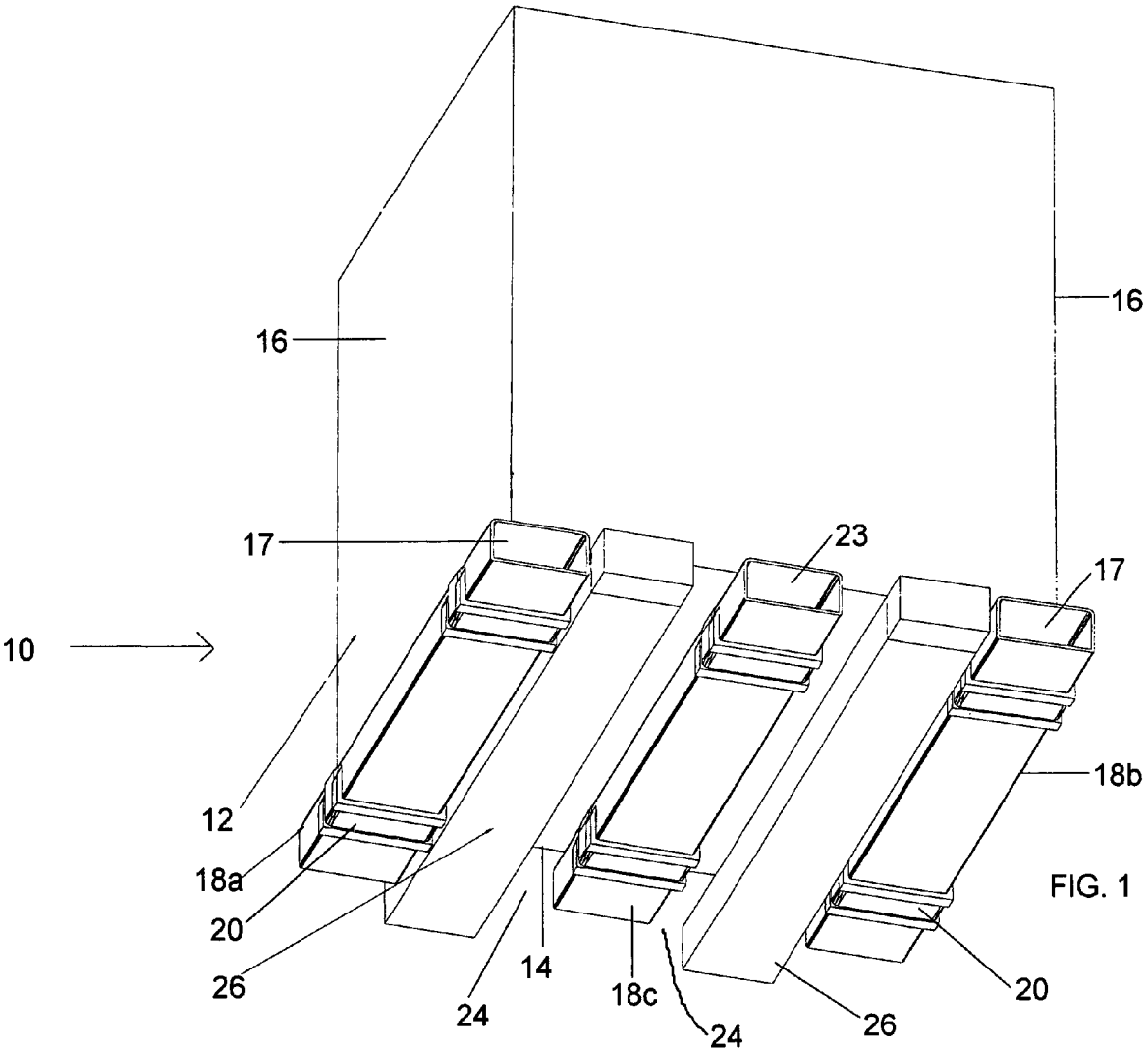
FIG. 1 is a bottom perspective view of a bulk bag handling assembly fabricated in accordance with the teachings of the present invention.

The preferred embodiment, a bulk bag handling assembly generally identified by reference numeral 10, will now be described with reference to FIGS. 1 through 5. A variation will be described with respect to FIGS. 6 and 7.

Structure and Relationship of Parts:

Referring to FIG. 1, bulk bag handling assembly 10 includes a bulk bag 12 having a bottom 14 and opposed pairs of peripheral side walls 16. A pair of enclosed outer lifting tine receiving channels 17 are formed by two tubular supports 18*a* and 18*b*. Tubular supports 18*a* and 18*b* are secured along bottom 14 in parallel spaced relation to one of the opposed pairs of peripheral side walls 16. Tubular supports 18*a* and 18*b* have walls 19, which define outer lifting tine receiving channels 17. A pair of open inner lifting tine receiving channels 24 are positioned between outer lifting tine receiving channels 17. Inner lifting tine receiving channels 24 are formed by securing an elongated intermediate support 18*c* in parallel spaced relation to tubular supports 18*a* and 18*b* along bottom 14 of bulk bag 12 in an intermediate position between tubular supports 18*a* and 18*b*. Intermediate support 18*c* supports bottom 14 of bulk bag 12 and thereby creates inner lifting tine receiving channels 24 on either side of intermediate support 18*c*.

In the drawings intermediate support 18*c* is illustrated as being tubular. It will appreciated that intermediate support 18*c* need not be tubular. However, when it is tubular it will, like tubular supports 18*a* and 18*b*, have walls 21 that define an enclosed intermediate lifting tine receiving channel 23.

Tubular supports 18*a* and 18*b*, as well as intermediate support 18*c* are illustrated as being secured to bottom 14 of bulk bag 12 by means of straps 20. A great deal of the patent literature deals with alternative ways to secure tubular tine receiving channels to the bottom of bulk bags. It will, therefore, be appreciated that there are other alternatives.

Figure 2:
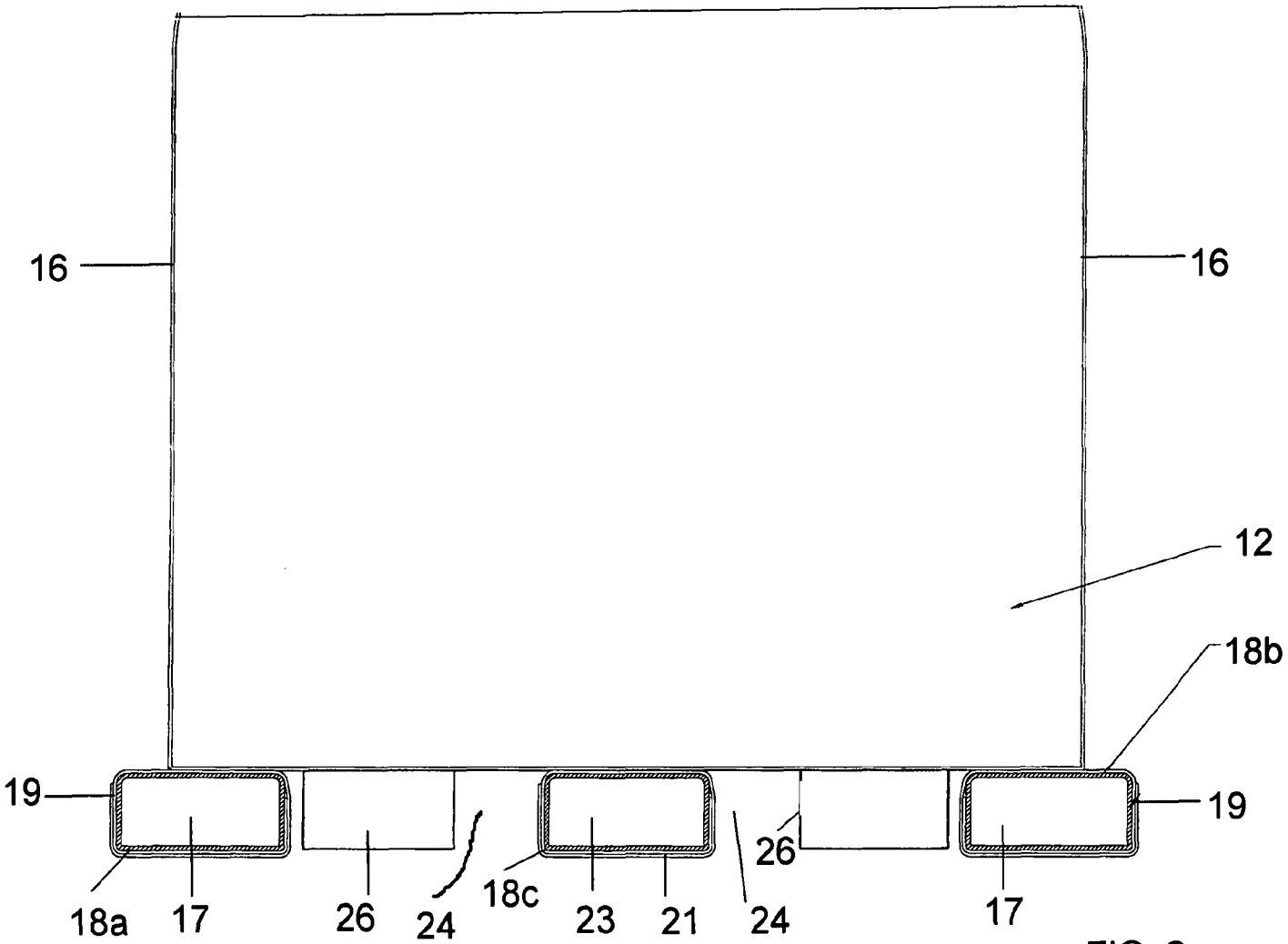
FIG. 2 is a front elevation view, in section, of the bulk bag handling assembly illustrated in FIG. 1.
Figure 3:
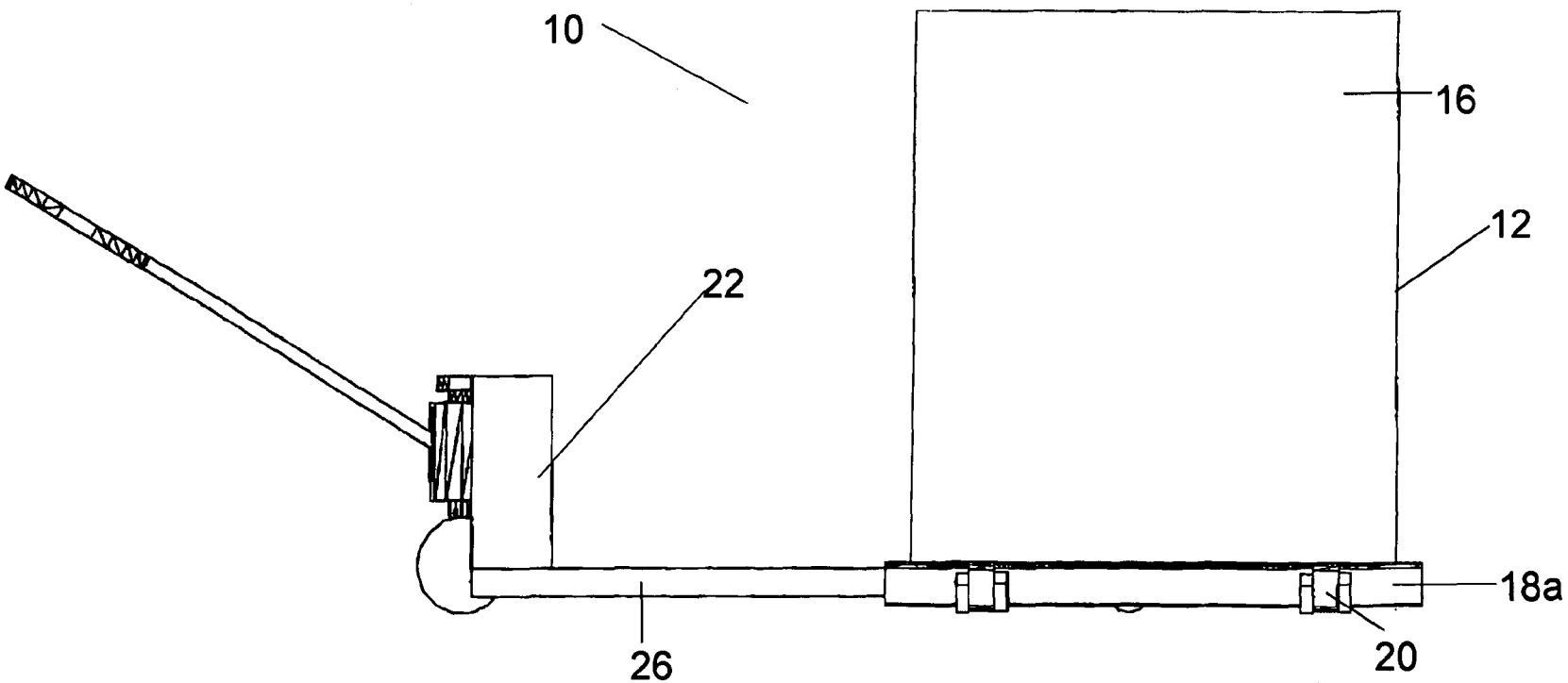
FIG. 3 is a side elevation view of the bulk bag handling assembly illustrated in FIG. 1, being used with a pallet truck.
Figure 4:
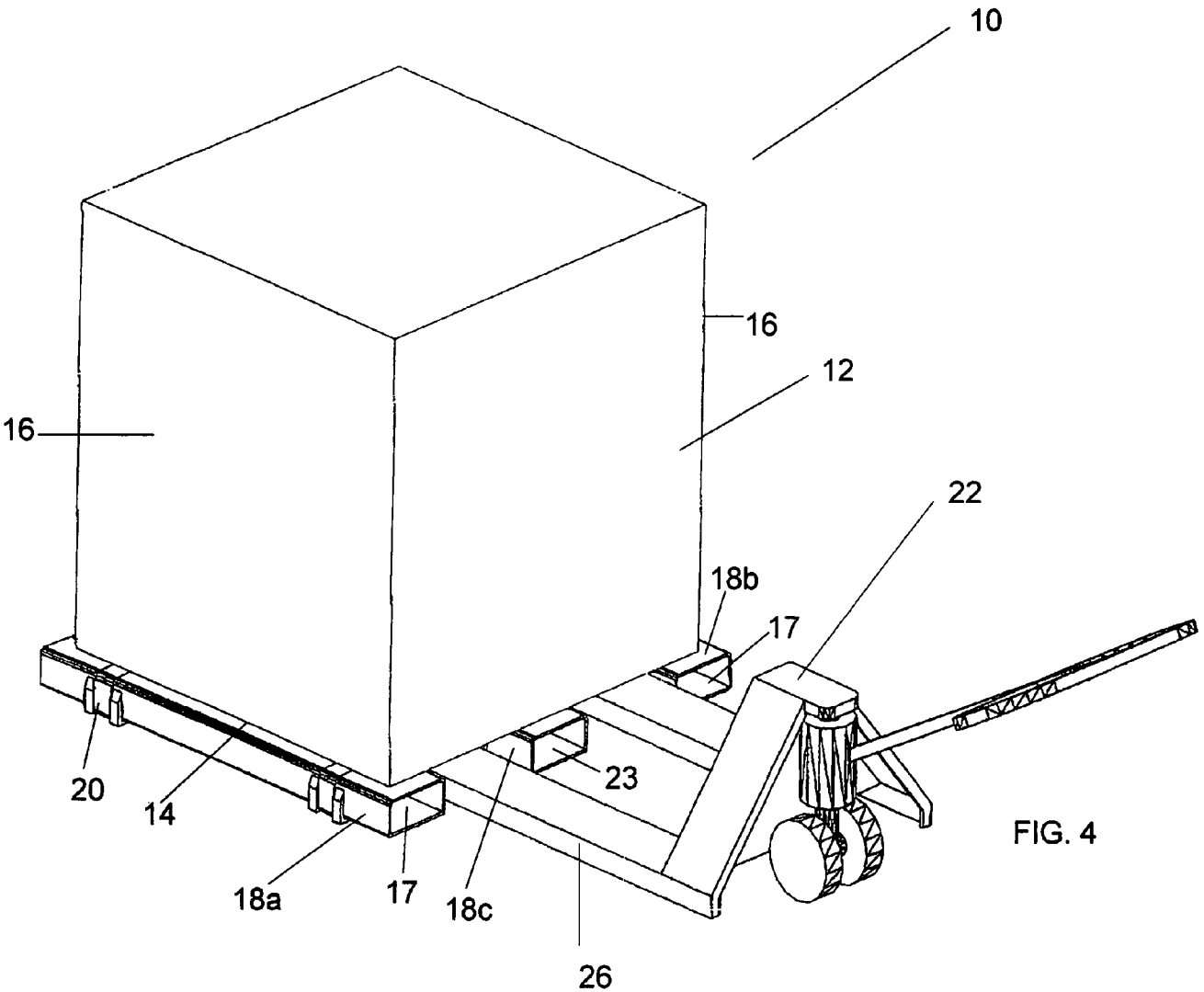
FIG. 4 is a front perspective view of the bulk bag handling assembly illustrated in FIG. 1, being used with a pallet truck.
Figure 5:
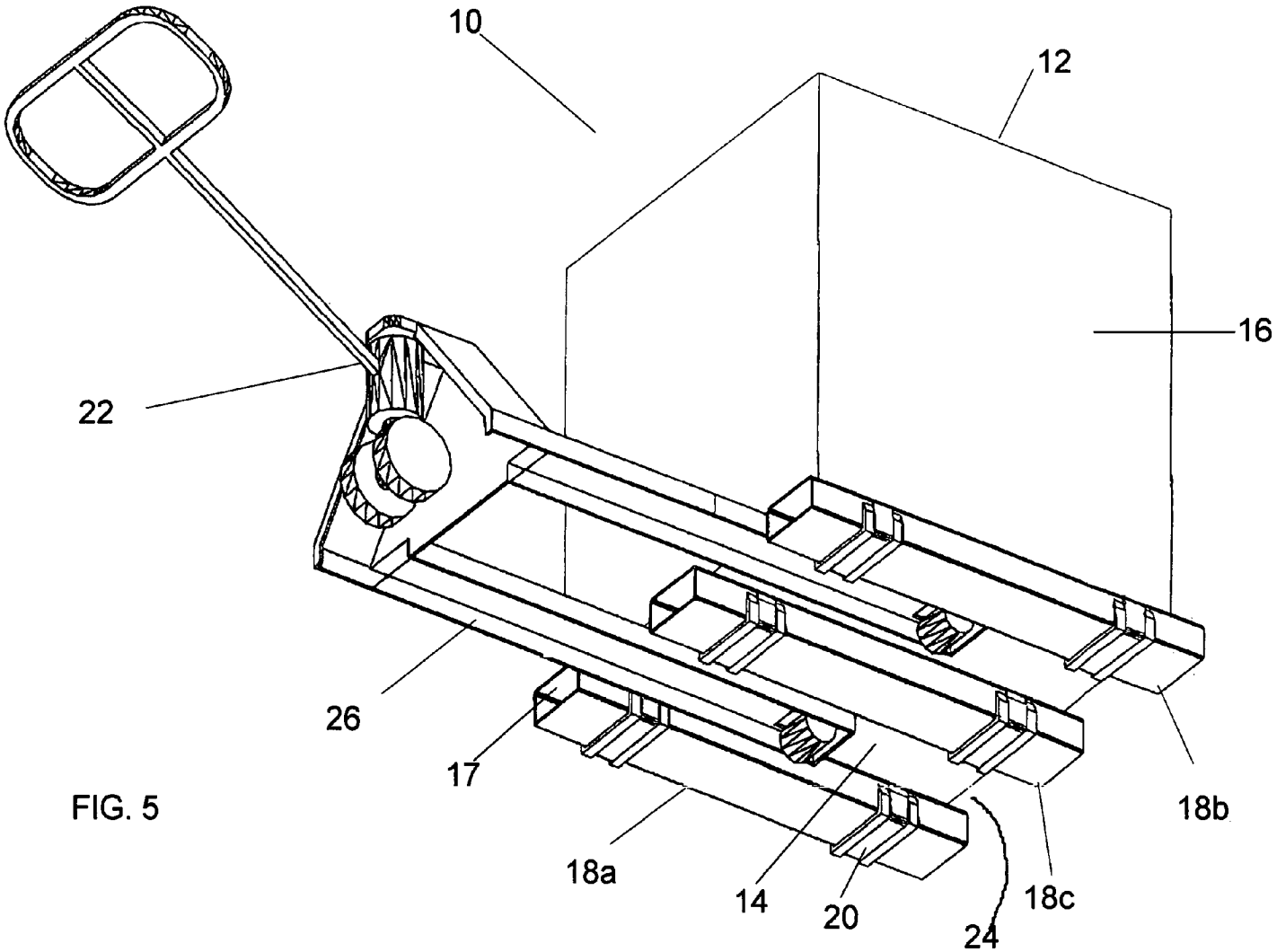
FIG. 5 is a bottom perspective view of the bulk bag handling assembly illustrated in FIG. 1, being used with a pallet truck.

Operation:

The use and operation of bulk bag handling assembly 10 will now be described with reference to FIG. 1 through FIG. 5. Referring to FIG. 2, tubular supports 18*a* and 18*b*, along with intermediate support 18*c*, are secured to bottom 14 of bulk bag 12. Referring to FIG. 1, in the illustrated embodiment, this is done by means of straps 20. This enables lifting tines to be inserted into outer channels 17, as is well known in the art. However, this also enables lifting tines 26 to be inserted into inner channels 24. If required, intermediate channel 23 may also be used.

Advantages:

An impediment to the universal adoption of bulk bag handling assemblies has been the wide variety of lifting equipment employed with differing lift tine spacing. Often a combination of lifting equipment is used within the same facility. Almost invariably, a combination of lifting equipment is used to move bulk bag 12 from the originating facility, through transportation and warehousing facilities to the end users facility. Bulk bag handling assembly 10, as described above, provides what has been missing. Bulk bag handling assembly 10 can be used with virtually any type of lifting equipment. Fork lifts can lift bulk bag 12, by inserting their lifting tines into outer channels 17. Pallet trucks 22 (also commonly known as pallet jacks) can lift bulk bag 12 by inserting their lifting tines into inner channels 24. In the past, should one of tubular supports 18*a* or 18*b* become damaged, problems were experienced in moving bulk bag 12. With bulk bag handling assembly 10, fork lift operators can temporarily change the spacing of their lifting tines, and insert one of their lifting tines into one of inner channels 24 or even into intermediate channel 23. This same "staggered" lifting technique, using one of outer channels 17 and one of inner channels 24, can be used with lifting equipment having lift tine spacing other than that normally used for fork lifts or pallet trucks. 22.

Figure 6:
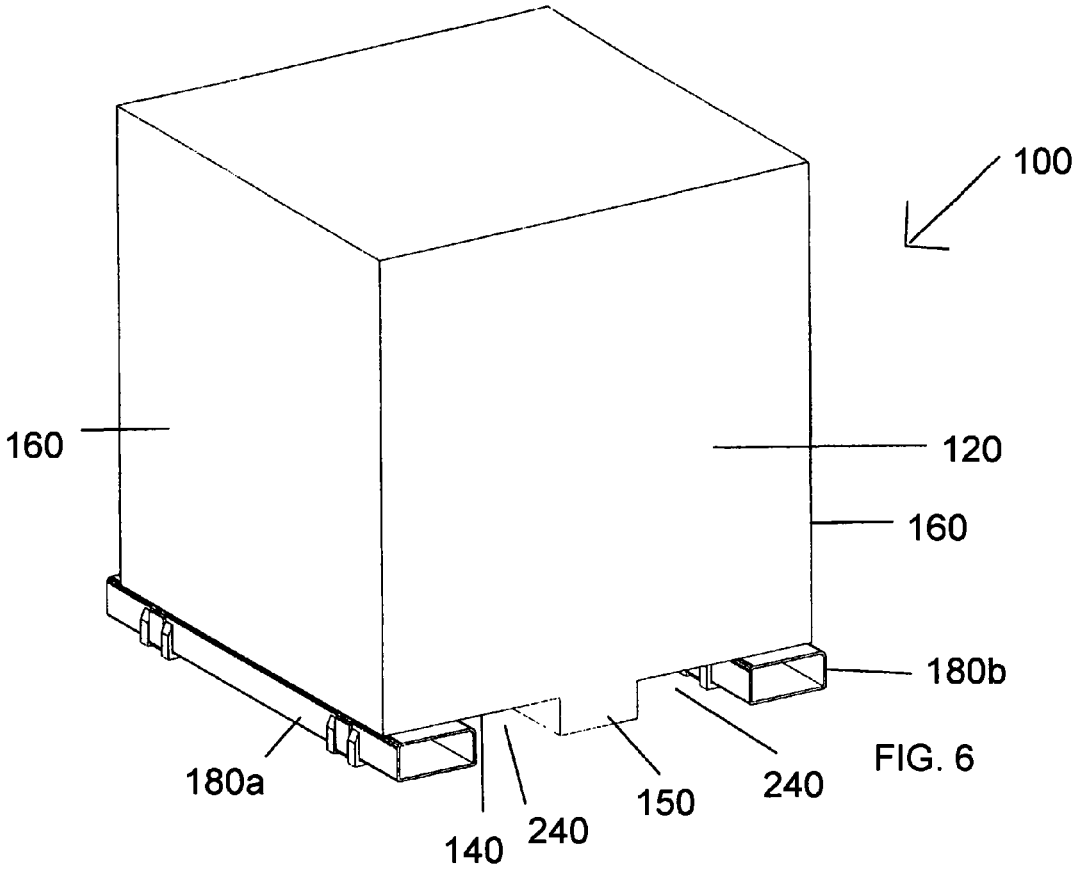
FIG. 6 is front perspective view of a variation of the bulk bag illustrated in FIG. 1, with a drop belly bottom.
Figure 7:
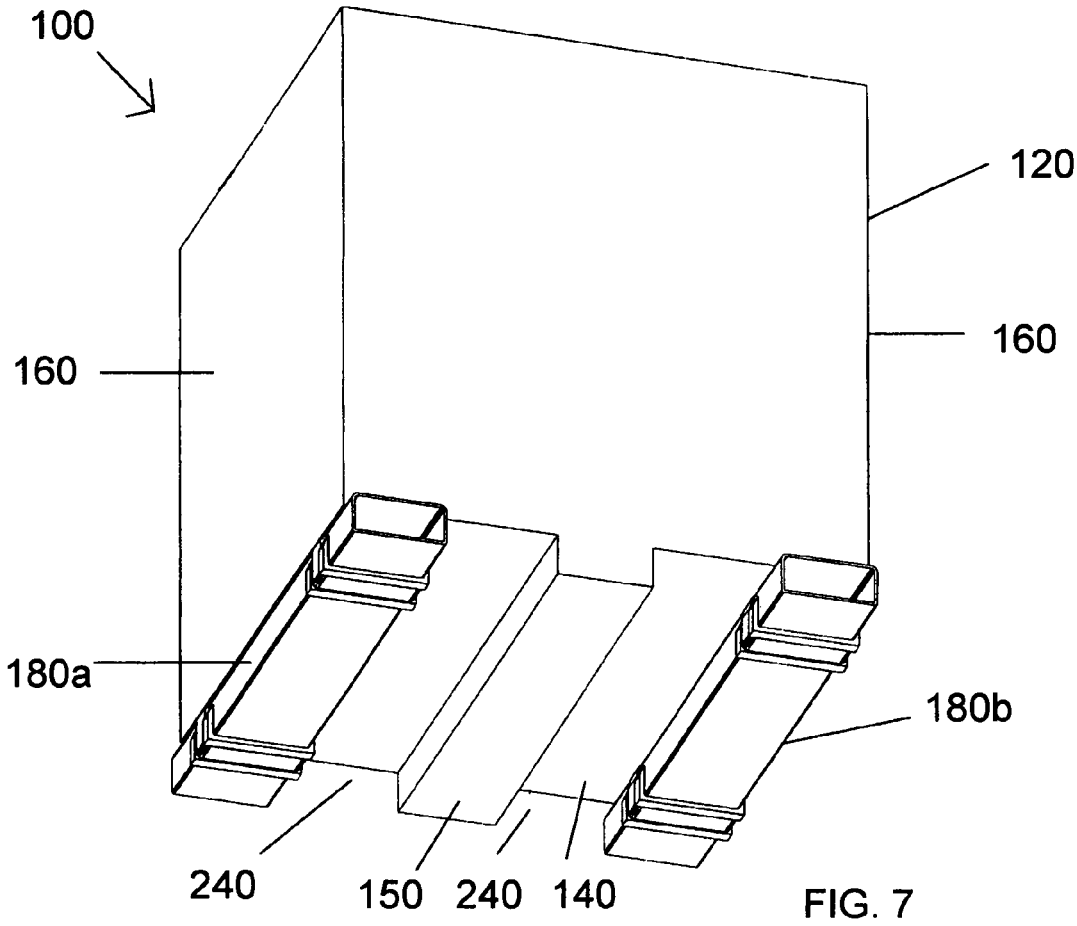
FIG. 7 is a bottom perspective view of the variation illustrated in FIG. 6.

Variations:

Referring to FIGS. 6 and 7, there is illustrated a variation of bulk bag handling assembly generally referenced by numeral 100. In the variation, handling assembly 100 includes a bulk bag 120 having a bottom 140 and opposed pairs of peripheral side walls 160. As with bulk bag 10, a pair of enclosed outer lifting tine receiving channels are formed by two tubular supports 180*a* and 180*b*, however, with variation 100 there is no intermediate support 18*c*. With the variation, there is a "drop belly" portion 150 intermediate tubular supports 180*a* and 180*b* on bottom 140 of bulk bag 120 which creates open inner lifting tine receiving channels 240 on either side of "drop belly" portion 150. Referring to FIG. 7, in the illustrated embodiment, "drop belly" portion 150 has a downwardly protruding rectangle shape, although it will be appreciated that it could have other shapes as well.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A bulk bag handling assembly comprising in combination:

a bulk bag having a bottom and opposed pairs of peripheral side walls, and the bulk bag being formed from a flexible material;

a pair of outer lifting tine receiving channels along the bottom in parallel spaced relation to one of the opposed pairs of peripheral side walls, the outer lifting tine receiving channels being defined by walls of a pair of elongated outer supports secured in parallel spaced relation across the bottom of the bulk bag, and the outer lifting tine receiving channels being parallel to the elongated supports;

a pair of inner lifting tine receiving channels positioned between and parallel to the outer lifting tine receiving channels;

an elongated intermediate support positioned in parallel spaced relation to the outer supports and integrally formed in the bottom of the bulk bag as a central drop belly portion in an intermediate position between the outer supports, the intermediate support supporting the bottom of the bulk bag and thereby creating the inner lifting tine receiving channels on either side of the intermediate support, and the inner lifting tine receiving channels having an open bottom access; and each of the elongated supports and the elongated intermediate support being independently connected to the bottom of the bulk bag, thereby leaving the inner tine receiving channels free of obstruction.

2. The bulk bag handling assembly as defined in claim 1, wherein the walls of the outer supports are tubular and enclose the outer lifting tine receiving channels.

* * * * *